US005594224A

United States Patent [19]

Tanimizu et al.

[11] Patent Number: 5,594,224

[45] Date of Patent: Jan. 14, 1997

[54] VACUUM CIRCUIT INTERRUPTER

[75] Inventors: Toru Tanimizu; Yoshimi Hakamata; Masato Kobayashi, all of Hitachi; Akira Osaka, Hitachinaka; Katsuhiro Komuro, Hitachi, all of Japan

[73] Assignee: Hitachi, Ltd., Tokyo, Japan

[21] Appl. No.: 358,954

[22] Filed: Dec. 19, 1994

[30] Foreign Application Priority Data

Dec. 24, 1993 [JP] Japan ..... 5-326607
Dec. 24, 1993 [JP] Japan ..... 5-326608

[51] Int. Cl.[6] ..... H01H 33/66

[52] U.S. Cl. ..... 218/134; 218/135

[58] Field of Search ..... 200/61.86, 262–270; 218/118, 119, 121, 123.125, 134, 135, 136, 137, 138, 139; 29/622

[56] References Cited

U.S. PATENT DOCUMENTS

| | | | |
|---|---|---|---|
| 2,892,912 | 6/1959 | Greenwood et al. | 218/136 |
| 3,129,308 | 4/1964 | Yokoyama et al. | 218/134 X |
| 3,141,058 | 7/1964 | Titus | 218/134 X |
| 3,430,015 | 2/1969 | Crouch et al. | 218/139 |
| 3,469,049 | 9/1969 | Crouch et al. | 218/136 |
| 4,071,727 | 1/1978 | Crouch et al. | 218/135 |
| 4,077,114 | 3/1978 | Sakuma | 218/134 X |
| 4,481,390 | 11/1984 | Kashiwagi et al. | 218/134 |
| 4,486,631 | 12/1984 | Naya et al. | 218/132 X |
| 4,492,837 | 1/1985 | Crouch et al. | 218/134 |
| 4,528,432 | 7/1985 | Senba et al. | 218/134 |
| 4,672,156 | 6/1987 | Basnett | 218/135 |
| 4,880,947 | 11/1989 | Fey et al. | 218/118 |
| 5,120,918 | 6/1992 | Thomas et al. | 218/130 |

FOREIGN PATENT DOCUMENTS

| | | | |
|---|---|---|---|
| 051475 | 5/1982 | European Pat. Off. | H01H 33/66 |
| 286335 | 10/1988 | European Pat. Off. | H01H 33/66 |
| 2450794 | 10/1980 | France | H01H 33/66 |
| 59-175521 | 10/1984 | Japan | H01H 33/66 |
| 2-195618 | 8/1990 | Japan | H01H 33/66 |
| 5-41143 | 2/1993 | Japan | H01H 33/66 |
| 5-31245 | 5/1993 | Japan | H01H 33/66 |
| 2182804 | 5/1987 | United Kingdom | H01H 33/66 |

*Primary Examiner*—J. R. Scott

*Attorney, Agent, or Firm*—Fay, Sharpe, Beall, Fagan, Minnich & McKee

[57] ABSTRACT

A low cost and highly reliable vacuum circuit interrupter and a method of manufacturing the same improve production efficiency and vacuum tight sealing property of the vacuum circuit interrupter. In the vacuum circuit interrupter, within a sealed vacuum vessel 100 a pair of separable conductors in center axial direction of the sealed vacuum vessel composed of a stationary conductor 3 and a movable conductor 5 are disposed. The sealed vacuum vessel 100 is sealed in vacuum tightness in such a manner that an upper end portion 1A of a hollow cylindrical insulation body 1 is sealed with a flexible member 6 generally called a bellows and a metal end plate 7 by joining a movable conductor side 6A of the bellows 6 to the movable conductor 5 so as to permit separation of the movable conductor 5 from the stationary conductor 3 while maintaining the vacuum sealed condition in the vacuum sealed vessel 100, and by joining one end of the metal end plate 7 with the upper end portion 1A of the hollow cylindrical insulation body 1 and the other end thereof with a metal end plate side 6B of the bellows 6. A lower end portion 1B of the hollow cylindrical insulation body 1 is sealed with the stationary conductor 3 by itself.

9 Claims, 4 Drawing Sheets

VACUUM CIRCUIT INTERRUPTER

BACKGROUND OF THE INVENTION

The present invention relates to a vacuum circuit interrupter and, in particular, relates to a vacuum circuit interrupter and a method of manufacturing the same which are suitable for improving its vacuum tightness and production efficiency.

A vacuum circuit interrupter is an important element in a vacuum circuit breaker, and is composed by a vacuum vessel constituted by sealing both ends of a hollow cylindrical insulation body with metal end plates and a pair of separable electrodes constituted by a stationary conductor and a movable conductor disposed in the vacuum vessel. One of the electrodes is connected to the stationary conductor and the other end of the stationary conductor extends in vacuum tightness through the metal end plate. The other electrode is secured to one end of the movable conductor and the movable conductor is connected in vacuum tightness to the other metal end plate via a bellows.

Further, copper was used for the stationary and movable conductors and, since the joining portions with the hollow cylindrical insulation body of the metal end plates are subjected to many stresses and, in particular, by heating stress, a material such as phosphorus deoxidized copper, Fe—Ni alloy and Fe—Ni—Co alloy has been used for the metal end plates as disclosed in JP-A-5-41143(1993).

The above mentioned parts constituting the vacuum circuit interrupter are joined by brazing which makes use of a brazing metal as a joining member.

The brazing is performed in such a manner that a brazing material is placed between or near the members to be joined, and is heated at higher than the melting point of the brazing material in a furnace of non-oxidizing atmosphere such as a vacuum furnace or hydrogen furnace to melt the brazing material to thereby join the members. Further, TIG welding and plasma welding can be used for joining the parts constituting the vacuum circuit interrupter.

During production of a vacuum circuit interrupter, evacuation and brazing are performed at the same time in a vacuum furnace and the inside of the vacuum circuit interrupter is evacuated and vacuum sealed. For example, such a method is disclosed in JP-A-59-175521(1984) in which after partially assembling the parts the assembly is sealed in vacuum tightness in a vacuum furnace.

More specifically, both a stationary electrode, a stationary conductor and a stationary side metal end plate, and a movable electrode, a movable conductor, a metallic bellows and a movable side metal end plate, are first joined by brazing. Subsequently, the stationary side metal end plate and the movable side metal end plate are joined by brazing in a vacuum furnace to the hollow cylindrical insulation body in such a manner that the stationary side metal end plate and the movable side metal end plate sandwich the hollow cylindrical insulation body. After completing the brazing operation, silver plating is applied on the respective external connection terminal portions of the stationary and movable conductors.

Further, many investigations have been performed for improving vacuum sealing of the vacuum circuit interrupter. JP-B-5-31245(1993) discloses one such investigation in which an improvement of the brazing material for the joining member is proposed, and JP-A-2-195618(1990) discloses another investigation in which, in order to properly guide parts to be sealed, a ring shaped brazing member having a plurality of non-continuous projections along both inner and outer circumferences thereof is used.

For the purpose of vacuum sealing the inside of the vacuum circuit interrupter, if the parts are joined through a single brazing operation, no sufficient heat is transmitted through the single brazing operation for joining both the stationary conductor and the stationary electrode, and the movable conductor and the movable electrode; thereby reliable brazing cannot be obtained. For this reason, the joining method as explained above was used in which both the stationary electrode, the stationary conductor and the stationary side metal end plate, and the movable electrode, the movable conductor, the metallic bellows and the movable side metal end plate, are first joined by brazing, and subsequently, the stationary side metal end plate and the movable side metal end plate are joined by brazing in a vacuum furnace to the hollow cylindrical insulation body. With such a method it is found out that the brazing operation time is prolonged which decreases production efficiency (work efficiency) and increases the production cost of such vacuum circuit interrupters.

Further, when silver plating is applied to the connecting portions with the external conductors of the stationary and movable conductors after the brazing operation between the parts, a solvent such as acid and a plating electrolyte are coated on the surface of the connecting portions. However, these materials show a corrosive property such that when these corrosive materials remain at the vacuum circuit interrupter, a significant problem such as vacuum leakage and the like is caused. Therefore the corrosive materials have to be completely removed which requires substantial time and further reduces production efficiency (work efficiency) and increases production cost of the vacuum circuit interrupter. Further, when joining the parts constituting the vacuum circuit interrupter in the vacuum furnace, heat is supplied through radiation to the vacuum circuit interrupter so as to melt the brazing material of the joint member; however, copper, which is a major constituent material, is likely to reflect the radiation heat and absorbs a limited amount of heat so that it takes time for heating the vacuum circuit interrupter and prevents a uniform reditation heat transmission, causing a non-uniform melting of the brazing material of the joining member which induces vacuum leakage.

Further, in the conventional vacuum circuit interrupter as indicated above, since a material such as Fe—Ni alloy and Fe—Ni—Co alloy different from the conductor material Cu was used for the metal end plates and further, many constituent parts were required, joint portions which require a vacuum-tight seal expand, which also induces vacuum leakage.

Further, although with the conventional method, such as one using an improved brazing material of a joint member or guiding members by a plurality of projections formed on the joint member, the vacuum-tight sealing property of the vacuum circuit interrupter is improved; however, no vacuum circuit interrupters having a reliable vacuum-tight sealing structure have been obtained until now. Accordingly, the vacuum-tight sealing properties of the conventional vacuum circuit interrupters are still insufficient.

SUMMARY OF THE INVENTION

An object of the present invention is to provide a low cost and highly reliable vacuum circuit interrupter and a method of manufacturing the same which improve production efficiency and the vacuum-tight sealing property of the vacuum circuit interrupter.

To obtain a vacuum circuit interrupter which achieves the above object, the vacuum circuit interrupter according to the present invention includes a hollow cylindrical insulation body, a pair of separable conductors disposed within the hollow cylindrical insulation body and a flexible member which connects one of the conductors with one end of the hollow cylindrical insulation body in such a manner to permit separation of the one conductor from the other conductor while maintaining vacuum tightness inside the hollow cylindrical insulation body, and wherein the other end of the hollow cylindrical insulation body is sealed in vacuum tightness by the other conductor.

Further, to obtain a vacuum circuit interrupter which achieves the above object, in the vacuum circuit interrupter according to the present invention, a pair of separable conductors are disposed within a hollow cylindrical insulation body and one end side of the hollow cylindrical insulation body is sealed in vacuum tightness via an end plate and a bellows, and the other end side of the hollow cylindrical insulation body is sealed in vacuum tightness via one of the conductors.

Further, to obtain a vacuum circuit interrupter which achieves the above object, in the vacuum circuit interrupter according to the present invention, a pair of separable conductors constituting a stationary conductor and a movable conductor are disposed in a hollow cylindrical insulation body and one end side of the hollow cylindrical insulation body is sealed in vacuum tightness via an end plate and a bellows, and the other end side of the hollow cylindrical insulation body is sealed in vacuum tightness via the stationary conductor.

Further, the material of the stationary conductor near the joint portion with the hollow cylindrical insulation body is constituted by a Cu alloy containing 1~10 wt % Cr.

Moreover, the cross sectional area of the stationary conductor near the joint portion with the hollow cylindrical insulation body is varied depending on the variation of magnitude of bending moment with respect to distance near the joint portion.

Further, the stationary conductor is provided with a groove at the end thereof which constitutes the joint portion with the hollow cylindrical insulation body, and with an inwardly projecting face into the hollow cylindrical insulation body in comparison with the joining portion between the stationary conductor and the hollow cylindrical insulation body.

Further to obtain a vacuum circuit interrupter which achieves the above object, in the vacuum circuit interrupter according to the present invention, a pair of separable conductors constituting a stationary conductor and a movable conductor are disposed in a hollow cylindrical insulation body. One end side of the hollow cylindrical insulation body is sealed in vacuum tightness via an end plate and a bellows, while the other end side of the hollow cylindrical insulation body is sealed in vacuum tightness via the stationary conductor. Further, at least one of the spaces between the stationary conductor and the hollow cylindrical insulation body, and the space between the movable conductor and the hollow cylindrical insulation body, is double sealed in vacuum tightness.

Further, the stationary conductor is provided with at least two joint portions with the hollow cylindrical insulation body, and the space between the joint portions is evacuated.

Further, a plurality of bellows are provided, one ends of the plurality of bellows are joined to the movable conductor, at least one of the other ends of the plurality of bellows is joined to the hollow cylindrical insulation body, and the space between the plurality of bellows is evacuated.

Further, to obtain a vacuum circuit interrupter which achieves the above object, in the vacuum circuit interrupter according to the present invention, a pair of separable conductors constituting a stationary conductor and a movable conductor are disposed within a hollow cylindrical insulation body, one end side of the hollow cylindrical insulation body is sealed in vacuum tightness via an end plate and a bellows, the other end side hollow cylindrical insulation body is sealed in vacuum tightness via the stationary conductor, and the joining portion of the stationary conductor with the hollow cylindrical insulation body is joined by making use of a ring shaped brazing member having a first bent portion formed along the inner circumference thereof which is designed to guide the stationary conductor, a second bent portion formed along the outer circumference thereof which is designed to guide the hollow cylindrical insulation body, and projections arranged along the circumference thereof at a predetermined interval.

Further, a plurality of bellows are provided, one ends of the plurality of bellows are joined to the movable conductor and at least one of the other ends of the plurality of the bellows is joined to the hollow cylindrical insulation body by making use of a ring shaped brazing member having a bent portion along the inner circumference thereof which is designed to guide the hollow cylindrical insulation body, and projections arranged along the circumference thereof at a predetermined interval.

Further, a plurality of bellows are provided, one ends of the plurality of bellows are joined to the movable conductor and at least one of the other ends of the plurality of bellows is joined to the end of the metal end plate at the hollow cylindrical insulation body side by making use of a ring shaped brazing member having a first bent portion formed along the inner circumference thereof which is designed to guide the metal end plate, a second bent portion formed along the outer circumference thereof which is designed to guide the hollow cylindrical insulation body, a step portion which is designed to guide at least one of the other ends of the plurality of bellows, and projections arranged along the circumference thereof at a predetermined interval.

To obtain a method of manufacturing a vacuum circuit interrupter which achieves the above object, in the method of manufacturing a vacuum circuit interrupter, on an end portion of a stationary conductor a first joining member is placed, on which the lower end portion of a hollow cylindrical insulation body is placed, a movable conductor is inserted into the hollow cylindrical insulation body, and second and third joining members are respectively placed on a bellows joining portion of the movable conductor and the upper end portion of the hollow cylindrical insulation body. One end of the bellows is placed on the bellows joining portion via the second joining member and one end of a metal end plate is placed on the upper end portion of the hollow cylindrical insulation body via the third joining member, and then a fourth joining member is placed on the other end of the metal end plate and the other end of the bellows is placed on the fourth joining member. Thereafter the assembly is heated in a vacuum furnace at a temperature higher than the melting temperature of the joining members while applying an external pressure onto the bellows joining portion to thereby produce the vacuum circuit interrupter.

Further, at least one of the stationary conductor and the movable conductor has a nickel plating, and the stationary conductor and the moveable conductor are conductively heated by contacting a heater to the nickel plated portion to produce the vacuum circuit interrupter.

The one end of the hollow cylindrical insulation body is sealed in vacuum tightness by the stationary conductor, and the conventional metal end plate is eliminated which has been connected in vacuum tightness to the stationary conductor to seal in vacuum tightness the lower end portion of the hollow cylindrical insulation body. Thereby, the number of joining portions between parts which constitute the vacuum circuit interrupter is decreased and the portions which require a vacuum-tight seal are accordingly limited. As a result, the number of portions which may be susceptible to vacuum leakage are reduced.

Further, the cross sectional area of the stationary conductor near the joining portion with the hollow cylindrical insulation body is varied depending on the variation of bending moment thereof with respect to the distance to the joining portion, and the material of the stationary conductor near the joining portion is composed of a Cu alloy containing 1~10 wt % Cr. The mechanical strength of that portion is thereby increased by about 40%. As a result, an adverse effect of a difference in thermal expansion coefficient between the stationary conductor and the hollow cylindrical insulation body is decreased.

Further, the stationary conductor is provided with the inwardly projecting face into the hollow cylindrical insulation body in comparison with the joining portion of the stationary conductor with the hollow cylindrical insulation body. Thereby, electrical field concentration at top end portions of the brazed material caused during voltage application is relaxed.

Further, at least one of the space between the stationary conductor and the hollow cylindrical insulation body and the space between the movable conductor and the hollow cylindrical insulation body is double sealed in vacuum tightness, in that at least two joining portions between the stationary conductor and the hollow cylindrical insulation body are sealed in vacuum tightness or one ends of a plurality of bellows are sealed in vacuum tightness to the movable conductor and at least one of the other ends of the plurality of the bellows is sealed in vacuum tightness to the hollow cylindrical insulation body. Thereby, vacuum tightness of the possible vacuum leakage portions is enhanced.

Further, the joining portion of the stationary conductor is joined with the hollow cylindrical insulation body by making use of a ring shaped brazing member having a first bent portion formed along the inner circumference thereof which is designed to guide the stationary conductor, a second bent portion formed along the outer circumference thereof which is designed to guide the hollow cylindrical insulation body, and projections arranged along the circumference at a predetermined interval. Thereby, evacuation and maintenance of vacuum at the double sealed structure portions are enabled. Further, with the provision of the bent portions, the joining portions between parts are strengthened and vacuum tightness of the possible vacuum leakage portions is enhanced. Still further, with this structure the brazing material is uniformly spread over the joining portions between the parts, and reliable joining portions are obtained.

Further, a plurality of bellows are provided, one ends of the plurality of bellows are joined to the movable conductor, and at least one of the other ends of the plurality of bellows is joined to the hollow cylindrical insulation body by making use of a ring shaped brazing member having a bent portion formed along the inner circumference thereof which is designed to guide the hollow cylindrical insulation body, and projections arranged along the circumference thereof at a predetermined interval. At least one of the other ends of the plurality of bellows is joined to the end of the metal end plate at the side of the hollow cylindrical insulation body by making use of a ring shaped brazing member having a first bent portion formed along the inner circumference thereof which is designed to guide the metal end plate, a second bent portion formed along the outer circumference thereof which is designed to guide the hollow cylindrical insulation body, a step portion which is designed to guide at least one of the other ends of the plurality of bellows, and projections arranged along the circumference thereof at a predetermined interval. Thereby, even at the movable conductor side, with the double sealing structure, vacuum tightness of the possible vacuum leakage portions is enhanced. Further, with the provision of the projections provided on the ring shaped brazing member, evacuation and maintenance of vacuum in the space between the plurality of bellows are enabled. Still further, with this structure the brazing material is uniformly spread over the joining portions between parts and reliable joining portions are obtained.

In the manufacturing of a vacuum circuit interrupter, on an end portion of a stationary conductor a first joining member is placed, on which the lower end portion of a hollow cylindrical insulation body is placed, then a movable conductor is inserted into the hollow cylindrical insulation body, and second and third joining members are respectively placed on a bellows joining portion of the movable conductor and the upper end portion of the hollow cylindrical insulation body. Then one end of the bellows is placed on the bellows joining portion via the second joining member and one end of a metal end plate is placed on the upper end portion of the hollow cylindrical insulation body via the third joining member, and a fourth joining member is placed on the other end of the metal end plate and the other end of the bellows is placed on the fourth joining member. Thereafter the assembly is heated in a vacuum furnace at a temperature more than the melting temperature of the joining members while applying external pressure onto the bellows joining portion to thereby produce the vacuum circuit interrupter. Thereby, all parts of the vacuum circuit interrupter are assembled in an order beginning from the stationary conductor located at the bottom portion while sandwiching the respective joining members therebetween. As a result, the vacuum circuit interrupter is produced by a single joining operation.

Further, at least one of the stationary conductor and the movable conductor has a nickel plating and the stationary conductor and the movable conductor are conductively heated by contacting a heater onto the nickel plated portion. Thereby, the vacuum circuit interrupter assembly efficiently absorbs the heat from the heater to thereby shorten the heating time thereof, and further the silver plating time required for the conventional manufacturing of vacuum circuit interrupters is also eliminated. As a result, the production time for the vacuum circuit interrupter is shortened.

DETAILED DESCRIPTION OF THE PREFERRED EMBODIMENTS

Hereinbelow, embodiments of the present invention are explained in detail with reference to the drawings.

Figure 1:
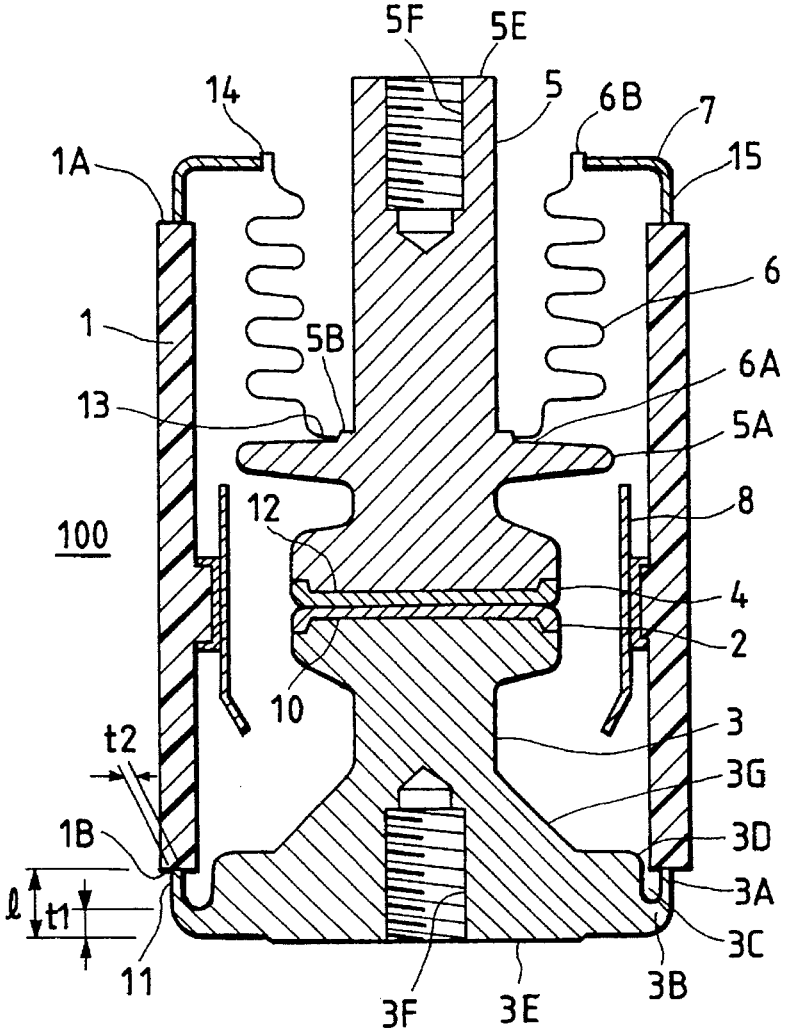
FIG. 1 is a vertical cross sectional view illustrating a characteristic structure of one embodiment of vacuum circuit interrupters according to the present invention.
Figure 2:
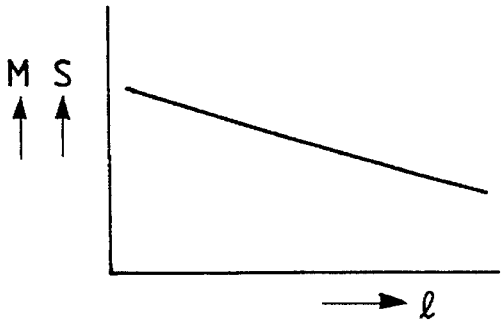
FIG. 2 is a graph illustrating a relationship between size, bending moment and cross sectional area of the joining portion of the stationary conductor in the vacuum circuit interrupter as shown in FIG. 1.

FIG. 1 is a cross sectional view of a vacuum circuit interrupter illustrating a first embodiment according to the present invention and FIG. 2 is a graph illustrating a relationship between size, bending moment and cross sectional area of the joining portion of the stationary conductor as shown in FIG. 1.

In the vacuum circuit interrupter according to the present embodiment, within a sealed vacuum vessel 100 a pair of separable conductors are disposed in the center axial direction of the sealed vacuum vessel composed of a stationary conductor 3 and a movable conductor 5.

The sealed vacuum vessel 100 is sealed in vacuum tight in such a manner that an upper end portion 1A of a hollow cylindrical insulation body 1 is sealed with a flexible member 6 (generally called a bellows) and a metal end plate 7 by joining a movable conductor side 6A of the bellows 6 to the movable conductor 5 so as to permit separation of the movable conductor 5 from the stationary conductor while maintaining the vacuum sealed condition in the vacuum sealed vessel 100, and by joining one end of the metal end plate 7 with the upper end portion 1A of the hollow cylindrical insulation body 1 and the other end thereof with a metal end plate side 6B of the bellows 6. A lower end portion 1B of the hollow cylindrical insulation body 1 is sealed with the stationary conductor 3.

To one end of the stationary conductor 3 a stationary electrode 2 is joined and the other end thereof is provided with a threaded portion 3F for connecting an external conductor (not shown). A rod shaped conductor is thus formed which extends from the stationary electrode 2 and through the stationary conductor 3 to a stationary side electrical contacting face 3E which permits current flow therethrough.

The stationary side electrical contacting face 3E of the stationary conductor 3 is formed in an umbrella shape extending radially. At the end of the radially extended portion a groove 3C is formed, and through the formation of the groove 3C, a joining base portion 3B and a joining end portion 3A, which is permitted to join with the lower end 1B of the hollow cylindrical insulation body 1 at the top thereof, are formed.

The problem caused by the thermal expansion coefficient differences of the materials at the joining portion is controlled by reducing the thickness of the joining end portion 3A near the joining portion. However, such thickness reduction causes a decrease of mechanical strength of those portions; therefore, in the present embodiment, in order to obtain a required mechanical strength for the portion near the joining end portion 3A, a reenforced copper alloy containing 1~10 wt % Cr is used therefor. Further, the cross sectional area (S) of from the joint base portion 3B to the joint end portion 3A is gradually decreased from the joint base portion 3B depending on the variation of the bending moment (M) acting thereon with regard to the distance (1) from the joint base portion 3B to the joint end portion 3A as illustrated in FIG. 2. More specifically, the thickness reduces gradually from the thickness t1 at the joint base portion 3B to the thickness t2 at the top of the joint end portion 3A.

Further, at the center axis side of the groove 3C a projecting face 3D is formed which projects farther toward the stationary electrode 2 than does the joining end portion 3A, and an inclining portion 3G having a gradually expanding diameter extends into the center portion of the stationary conductor 3 from the projecting face 3D.

Still further, on the surface of the stationary conductor 3, nickel plating is applied.

At one end of the movable conductor 5 a movable electrode 4 is joined and at the other end thereof a threaded portion 5F is provided which is for connecting with an external conductor (not shown). A rod shaped conductor is thereby formed which extends from the movable electrode 4 and through the movable conductor 5 to a movable side electrical contacting face 5E which permits current flow therethrough.

At the intermediate portion of the movable conductor a bellows protection shield 5A projecting outwardly is constituted having a larger outer diameter than that of the metallic bellows 6, and at the root portion of the protection a metallic bellows joint portion 5B is provided which permits joining with a movable conductor side end 6A of the metallic bellows 6.

Further, the movable conductor 5 is made of a reenforced copper alloy containing 1~10 wt % Cr like that near the joining end portion 3A of the stationary conductor 3 as explained above, and is also plated by nickel like the stationary conductor 3 as explained above.

The metallic bellows 6 is provided with the movable conductor side end 6A at one end thereof which is adapted to be joined with the bellows joining portion 5B, and a metal end plate side end 6B at the other end which is adapted to be joined with the movable conductor side metal end plate 7. The movable conductor side metal end plate 7 is adapted to join with the metal end plate side end 6B of the metallic bellows 6 at the inner circumference thereof and with the upper end 1A of the hollow cylindrical insulation body 1 at the outer circumference thereof.

Further, a shield 8 surrounding the stationary electrode 2 and the movable electrode 4 is supported by the inner wall of the hollow cylindrical insulation body 1.

Figure 3:
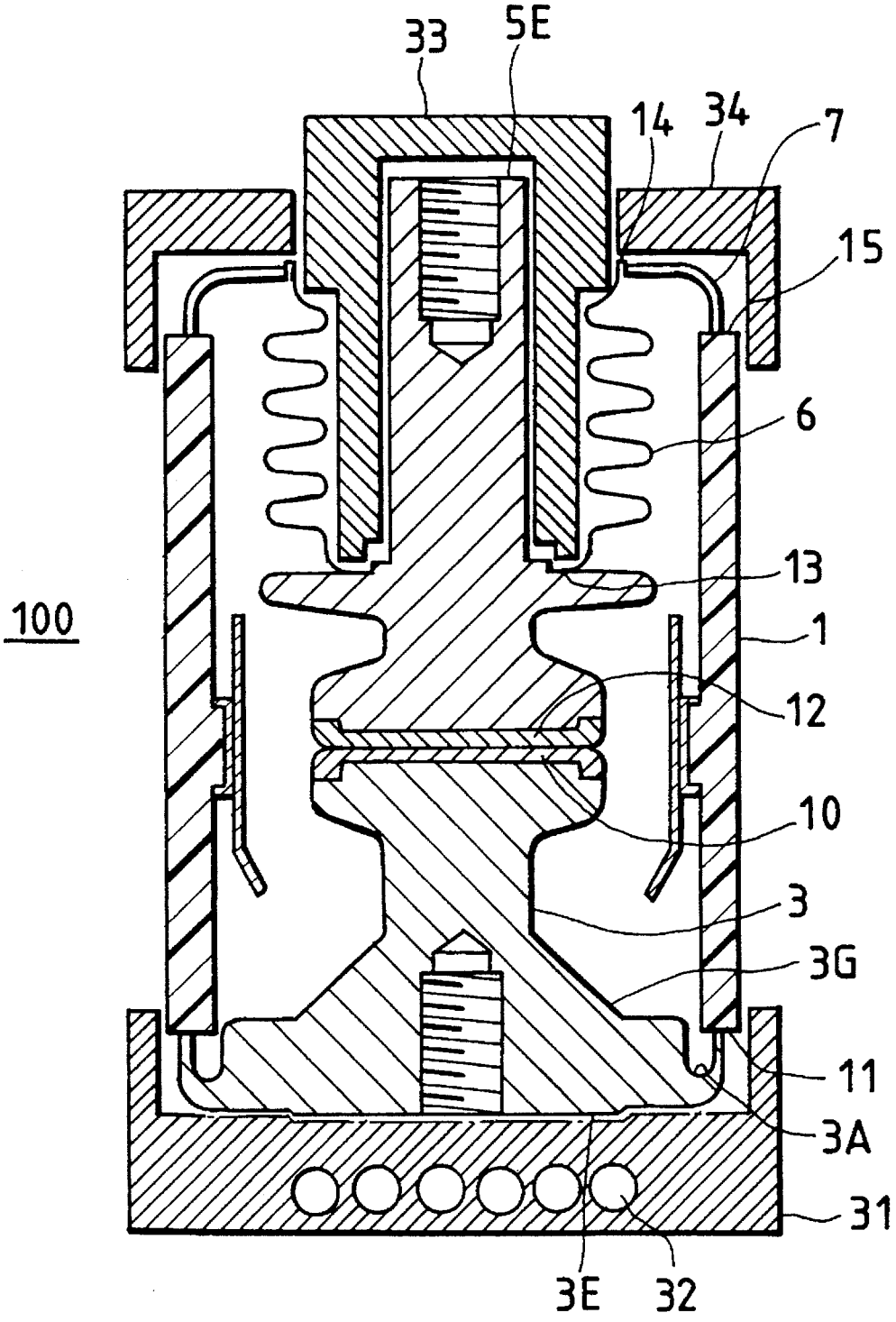
FIG. 3 is a vertical cross sectional view for explaining a manufacturing method of the vacuum circuit interrupter as shown in FIG. 1.

Now, a manufacturing method of the above explained vacuum circuit interrupter is explained with reference to FIG. 3. Namely, the vacuum circuit interrupter is manufactured according to the following steps.

I. The stationary conductor 3 is fitted into a lower supporting stand 31 incorporating a heater 32 inside thereof while contacting the stationary side electrical contacting face 3E, and above the stationary conductor 3 a brazing member 10 and the stationary electrode 2 are fitted.

II. On the joint end portion 3A a ring shaped brazing member 11 and the lower end portion 1B of the hollow cylindrical insulation body 1 are placed successively and the hollow cylindrical insulation body 1 is also fitted into the lower supporting stand 31.

III. From above the hitherto assembled body, the movable conductor 5 fitted with a brazing member 12 and the movable electrode 4 therebelow is inserted until the movable electrode 4 contacts the stationary electrode 2 and is supported thereby.

IV. Then, on the upper end portion 1A of the hollow cylindrical insulation body 1 a brazing member 15 and the movable conductor side metal end plate 7 are placed.

V. On the metallic bellows joint portion 5B of the movable conductor 5 a brazing member 13 and the movable conductor side end 6A of the metallic bellows 6 are placed. Then, on the upper portion of the inner circumference of the movable conductor side metal end plate 7, a brazing member 14 is placed and the metal end plate side end 6B of the metallic bellows 6 is placed thereon.

VI. Under the above explained assembled condition, an upper center pressing metal piece 33 is inserted which presses the movable conductor side end 6A of the metallic bellows 6 and the brazing member 13 while heating the same, further another upper pressing metal piece 34 is placed onto the movable side metal end plate 7, the brazing member 14 and the metal end plate side end 6B of the bellows 6 while pressing and heating the same.

VII. The thus assembled assembly is heated once in a vacuum furnace at a temperature higher than the melting temperature of the brazing members to complete a vacuum circuit interrupter.

According to the present embodiment, since the stationary conductor 3 is integrated up to the joint end portion 3A, the heat absorption of the stationary conductor 3 is improved by nickel plating the wide area from the stationary side electrical contacting face 3E to the joint end portion 3A, and since the stationary conductor 3 is directly heated through conduction by the heater 32, the stationary conductor 3 absorbs heat efficiently. Accordingly, a part of the large amount of heat supplied from the heater 32 is used for melting the brazing member 11 at the joint end portion 3A, and a major portion of the large amount of heat flows through the inclined portion 3G of the stationary conductor 3 having a large cross sectional area, and is used for melting the brazing member 10 at the stationary electrode 2. The brazing member 12 at the movable electrode 4 contacting to the stationary electrode 2 can also be thereby heated for melting the same.

Further, since the heat absorption of the movable conductor 5 is also improved by nickel plating the wide area of the movable conductor 5 from the movable conductor side electrical contacting face 5E to the metallic bellows joint portion 5B, and since the upper center pressing metal piece 33 presses directly by its weight the movable conductor side end 6A of the metallic bellows 6, the heat absorbed by the upper center pressing metal piece 33 of radiation heat in vacuum is absorbed into the movable conductor 5 through the nickel plated face of the movable conductor 5, and the contacting portion between the movable conductor side end 6A of the metallic bellows and the upper center pressing metal piece 33, whereby the brazing member 13 and the brazing member 12 at the movable electrode 4 are heated and melted.

Through the heating both from upper and lower sides the brazing members 10, 12 and 13 at the inside of the hollow cylindrical insulation body 1 are reliably melted to thereby reliably join the parts through a single joining operation. Further, because of the shortened heating time as well as the shortened work time, the production efficiency is improved, and in addition because of a uniform heat application to the respective joining portions a complete joint can be achieved.

Further, according to the present embodiment, with the integration up to the joint end portion 3A of the stationary conductor 3, the usual metal end plate at the stationary conductor side end portion of the hollow cylindrical insulation body is eliminated through the integration of the stationary conductor 3 and the metal end plate, and the number of joining portions between parts which require vacuum tightness is reduced. Thereby, possible vacuum leakage portions are reduced and vacuum tightness of the vacuum circuit interrupter is improved.

Further, in the stationary conductor 3 the cross sectional area (S) from the joint base portion 3B to the joint end portion 3A is gradually decreased from the joint base portion 3B depending on the variation of bending moment (M) acting thereon with regard to the distance (1) from the joint base portion 3B to the joint end portion 3A as illustrated in FIG. 2. More specifically, the thickness reduces gradually from the thickness t1 at the joint base portion 3B to the thickness t2 at the top of the joint end portion 3A.

Further, a reenforced copper alloy containing 1~10 wt % Cr is used for the stationary conductor 3 near the joining portion with the hollow cylindrical insulation body 1. Thus, the mechanical strength of those portions of the stationary conductor 3 is reenforced by about 40% in comparison with pure copper conductors. Thereby, the thickness t2 of the joint end portion 3A of the stationary conductor 3 is thinned by about 40%. Accordingly, even when a pressing force is acted on to the movable conductor side metal end plate 7 while fixing the stationary side electrical contacting face 3E as stationary plane and bending moments are respectively applied to the joint base portion 3B having thickness t1 and to the joint end portion 3A having thickness t2 of the stationary conductor 3, because of the above provision the influence due to a thermal expansion coefficient difference between the hollow cylindrical insulation body 1 and the joint end portion 3A is reduced, whereby a possibility of break-down of the joint portion is reduced. Further, the thickness of the joint end portion of the stationary conductor 3 can be easily adjusted by modifying the configuration of the groove 3C.

Further, the tops of the melted brazing member at the upper end 1A and the lower end 1B of the hollow cylindrical insulation member 1 are likely to be pointed, and during voltage application, an electric field concentrates therearound to generate corona discharge in the vacuum circuit interrupter which likely causes dielectric break-down of the vacuum circuit interrupter. However, according to the present embodiment, the projecting face 3D of the stationary conductor 3 is designed to project inwardly beyond the lower end 1B of the hollow cylindrical insulation body 1, the electric field at the top end portions of the melted brazing member during the voltage application is relaxed, the corona discharge is raised, and the dielectric break-down of the vacuum circuit interrupter is prevented.

Further, according to the present embodiment, like the stationary conductor 3 the reenforced copper of Cu alloy containing 1~10 wt % Cr is preferred for the movable conductor 5, therefore the mechanical strength of the movable conductor 5 is reenforced, and the possible deformation due to a large mechanical force during circuit making and breaking operation can also be reduced.

Further, according to the present embodiment, since the nickel plating is applied to the stationary conductor 3 and the movable conductor 5 before assembly thereof and the nickel plating never scatters at the brazing temperature of the brazing members, the nickel plating maintains its electrical contacting function even after the sealing operation in the vacuum furnace, and no plating is needed, as has been required after the sealing operation in the conventional manufacturing process. The manufacturing process of the vacuum circuit interrupter is thus shortened and the production efficiency improved, and thus as a matter of course the conventional problems such as remaining plating solution are eliminated.

Further, since the nickel plating shows a good wettability with the brazing materials, in particular, with a commonly used silver series brazing material, highly reliable joints are achieved both at the portions requiring vacuum tightness and at the portions requiring current conduction.

Still further, nickel shows a two-times higher withstand voltage than that of copper in vacuum, and the dielectric distance between the shield 8 and the stationary conductor 3 or the movable conductor 5 is shortened, whereby the diameter of the vacuum circuit interrupter can be reduced and the size of the vacuum circuit interrupter is also reduced.

In the present embodiment, through the use of the above explained structure and manufacturing method, the production efficiency and vacuum tightness of the vacuum circuit interrupter are improved. However, the vacuum tightness of vacuum circuit interrupters can also be improved through the use of the following structure which is explained with reference to FIG. 4 through FIG. 9.

Figure 4:
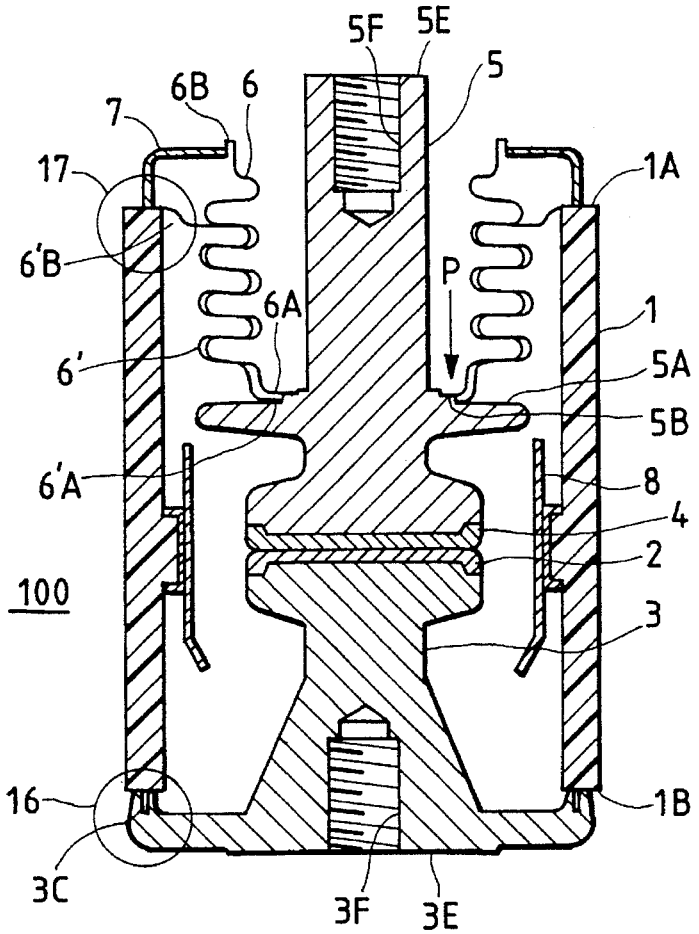
FIG. 4 is a vertical cross sectional view illustrating a characteristic structure of another embodiment of vacuum circuit interrupters according to the present invention.
Figure 5:
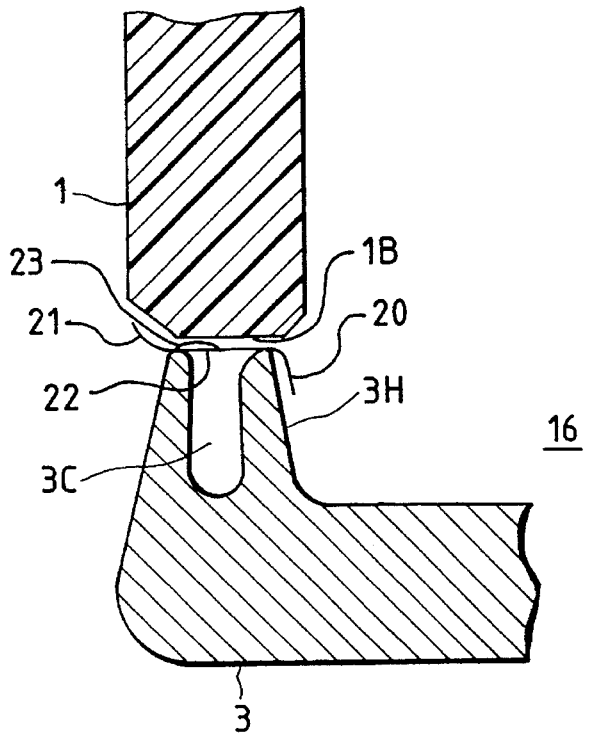
FIG. 5 is an enlarged view of the lower end joining portion of the hollow cylindrical insulation body in the vacuum circuit interrupter as shown in FIG. 4.
Figure 6:
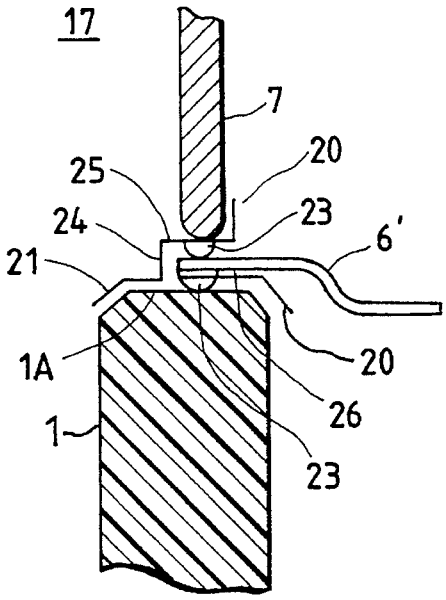
FIG. 6 is an enlarged view of the upper end joint portion of the hollow cylindrical insulation body in the vacuum circuit interrupter as shown in FIG. 4.
Figure 7:
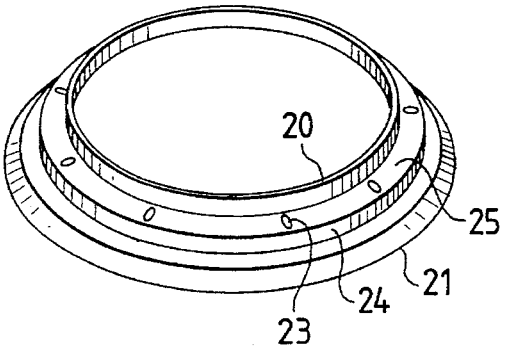
FIG. 7 is a perspective view illustrating the structure of one joining member used in one of the joining portions in FIG. 6.
Figure 8:
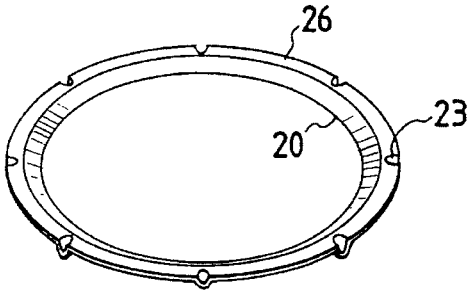
FIG. 8 is a perspective view illustrating the structure of another joining member used in the other joining portion in FIG. 6.
Figure 9:
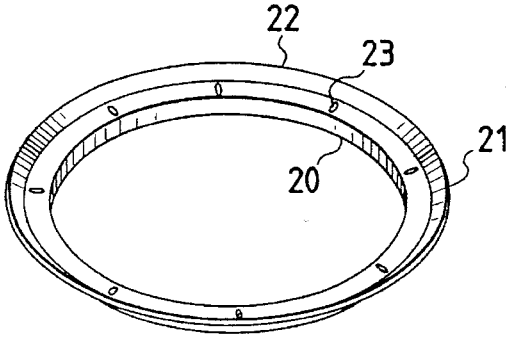
FIG. 9 is a perspective view illustrating the structure of still another joining member used in the joining portion in FIG. 5.

FIG. 4 is a cross sectional view of the vacuum circuit interrupter, FIG. 5 is an enlarged view of a joining portion 16 between the lower end portion 1B of a hollow cylindrical insulation body 1 and a stationary conductor 3, FIG. 6 is an enlarged view of a joining portion 17 between an upper end portion 1A of the hollow cylindrical insulation body 1 and a movable conductor metal end plate 7, and FIG. 7 through FIG. 9 are perspective views of respective brazing members used as joining members for the present embodiment. In the present embodiment the same and equivalent elements as in the previous embodiment are denoted by the same reference numerals and the explanation thereof is omitted.

In the vacuum circuit interrupter according to the present embodiment, the bellows is constituted in a double structure, including a movable conductor side bellows 6 and a hollow cylindrical insulation body side bellows 6'. In the movable conductor side bellows 6, the metal end plate side end 6B is joined at one end of the movable conductor side metal end plate 7 (the opposite end from that joined to the upper end portion 1A of the hollow cylindrical insulation body 1) along the inner circumference thereof and the movable conductor side end 6A is joined to the bellows joining portion 5B of the movable conductor 5. In the hollow cylindrical insulation body side bellows 6' the metal end plate side end 6'B is joined to the upper end portion 1A of the hollow cylindrical insulation body 1 and the movable conductor side end 6'A is also joined to the bellows joining portion 5B of the movable conductor 5.

On the bellows joining portion 5B of the movable conductor 5, a step is formed which corresponds to the thickness required when the movable conductor side end 6'A of the hollow cylindrical insulation body side bellows 6' is brazed, and the movable conductor side end 6A of the movable conductor side bellows 6 and the movable conductor side end 6'A of the hollow cylindrical insulation bellows 6' are respectively brazed while applying a predetermined pressing force P.

For joining the metal end plate side end 6'B of the hollow cylindrical insulation body side bellows 6' with the upper end portion 1A of the hollow cylindrical insulation body 1, a ring shaped movable conductor side inner brazing member 26 is used. The movable conductor side inner brazing member 26 is provided with an inner circumferential bent portion 20 which is designed to firmly guide the entire circumference of the upper end portion 1A of the hollow cylindrical insulation body 1, and a plurality of projections 23 which are designed to form gaps for evacuating the inside of the vacuum sealed vessel 100. The projections 23 are formed in a recess and projection shape along the circumference of the hollow cylindrical insulation body 1 at a predetermined interval.

The outer circumferential portion of the movable conductor side metal end plate 7 is joined on the metal end plate side end 6'B of the hollow cylindrical insulation body 6' via a ring shaped movable conductor side outer brazing member 25. The movable conductor side outer brazing member 25 is provided with an outer circumferential portion 21 which is designed to firmly guide the entire circumference of the upper end portion 1A of the hollow cylindrical insulation body 1, an inner circumferential bent portion 20 which is designed to guide the inner circumference of the movable conductor side metal end plate 7, a step portion which is designed to guide the outer circumferences of the movable conductor side inner brazing member 26 and the metal end plate side end 6'B of the hollow cylindrical insulation body side bellows 6', and a plurality of projections 23 which are designed to form gaps for evacuating the inside of the vacuum sealed vessel 100. The projections 23 are formed in a recess and projection shape along the circumference of the hollow cylindrical insulation body 1 at a predetermined interval. The radial width of the ring shaped outer movable side brazing member 25 constituting the joining portion 17 between the movable conductor side metal end plate 7 and the upper end portion 1A of the hollow cylindrical insulation body 1 is selected so as to extend from the outer circumference of the upper end portion 1A of the hollow cylindrical insulation body 1 to the inside of the metal end plate 7 and to cover the outer surface of the metal end plate side end 6'B of the hollow cylindrical insulation body side bellows 6'. As a result, the surfaces of the upper end portion 1A and the metal end plate side end 6'B are continuously coated with the brazing material after the brazing operation.

Further, in the present embodiment, the stationary conductor side electrical contacting face 3E of the stationary conductor 3 is formed in an umbrella shape, and at the end thereof the groove 3C is provided. With this groove 3C projections 3H at the end thereof are formed which are to be joined in ring shapes with the lower end portion 1B of the hollow cylindrical insulation body 1, and the projections 3H and the lower end portion 1B of the hollow cylindrical insulation body 1 are joined via a ring shaped stationary conductor side brazing member 22. The ring shaped stationary conductor side brazing member 22 is provided with an outer circumferential bent portion 21 which is designed to firmly guide the entire circumference of the lower end portion 1B of the hollow cylindrical insulation body 1, an inner circumferential bent portion 20 which is designed to firmly guide the entire circumference of the projection 3H, and a plurality of projections 23 which are designed to form gaps for evacuating the inside of the vacuum sealed vessel 100. The projections 23 are formed in a recess and projection shape along the circumference of the hollow cylindrical insulation body 1 at a predetermined interval.

Further, the vacuum circuit interrupter according to the present embodiment is manufactured by making use of substantially the same manufacturing method as explained in connection with the previous embodiment.

According to the present embodiment, the bellows is constituted in a double structure, including the movable conductor side bellows 6 and the hollow cylindrical insulation body side bellows 6', and at the end portion of the stationary conductor 3 the groove 3C is formed, whereby the vacuum-tight sealing portion is doubled and possible vacuum leakage portions are strengthened. Accordingly, the vacuum tightness of the vacuum circuit interrupter according to the present embodiment is further enhanced in comparison with the vacuum circuit interrupter according to the previous embodiment.

Further, with the provision of the projections 23 formed in recess and projection shape along the circumference of the hollow cylindrical insulation body 1, the space in the groove 3C at the end portion of the stationary conductor 3 and the space surrounded by the movable conductor side bellows 6, the hollow cylindrical insulation body side bellows 6' and the movable conductor side metal end plate 7 are evacuated as well as the inside of the sealed vessel 100 during the heating and evacuating operation.

Further, since the movable conductor side inner brazing member 26 is provided with the inner circumferential bent portion 20 which is designed to firmly guide the entire circumference of the upper end portion 1A of the hollow cylindrical insulation body 1; and since the movable conductor side outer brazing member 25 is provided with the outer circumferential bent portion 21 which is designed to firmly guide the entire circumference of the upper end portion 1A of the hollow cylindrical insulation body 1, the inner circumferential bent portion 20 which is designed to guide the inner circumference of the movable conductor side metal end plate 7, and the step portion 24 which is designed to guide the circumferences of the movable conductor side inner brazing member 26 and the metal end plate side end 6'B of the hollow cylindrical insulation body side bellows 6'; the joining portion 17 of the metal end plate side end 6'B of the hollow cylindrical insulation body side bellows 6', the upper end portion 1A of the hollow cylindrical insulation body 1 and the movable conductor side metal end plate 7 are kept under a predetermined condition, in that a vacuum sealed condition is maintained even if the movable conductor 5 is moved. Accordingly, the vacuum inside the sealed vacuum vessel is maintained, which is very advantageous for a vacuum circuit interrupter used under a condition requiring frequent switching.

Further, since substantially the same manufacturing method as explained in connection with the previous embodiment is used for the present embodiment, the joining can be completed reliably by a single joining operation. Further, because of a shortened heating time as well as a shortened work time, the production efficiency is improved, and in addition because of a uniform heat application to the respective joining portions a complete joint can be achieved.

Since the vacuum circuit interrupter according to the present invention is constituted as thus explained, the number of parts constituting the vacuum circuit interrupter is decreased and correspondingly joint portions requiring vacuum-tight seals are reduced; thereby vacuum tightness of the vacuum circuit interrupter is improved. Further, through the double sealing structure at joining portions of the parts and the improvement of the brazing members constituting the joining member, the vacuum tightness of the vacuum circuit interrupter is further improved.

Further, according to the present invention, the properties of absorption and conduction of heat which are required for melting the joining members of brazing material are improved, dielectric breakdown in the vacuum circuit interrupter and damage to the hollow cylindrical insulation body are prevented, the degree of the deformation to which the movable conductor is subjected during a circuit making and breaking operation is limited, and the size of the vacuum circuit interrupter is reduced.

Further, for the vacuum circuit interrupter of the present invention manufactured according to the manufacturing method as explained, the working process is shortened, working time is shortened because of shortened heating time (by a single joining operation), and through the uniform heat application to the joining portions the production efficiency of the vacuum valve is improved.

Accordingly, with the present invention a low cost and a highly reliable vacuum circuit interrupter and manufacturing method thereof are provided.

We claim:

1. A vacuum circuit interrupter in which a pair of separable conductors constituting a stationary conductor and a movable conductor are disposed in a hollow cylindrical insulation body and one end side of said hollow cylindrical insulation body is sealed in vacuum tightness via an end plate and a bellows, characterized in that said stationary conductor is attached to the other end side of said hollow cylindrical insulation body so as to seal said hollow cylindrical insulation body in vacuum tightness thereby at a joint portion therewith;

wherein the material of said stationary conductor near the joint portion with said hollow cylindrical insulation body is a Cu alloy containing 1~10 wt % Cr.

2. A vacuum circuit interrupter in which a pair of separable conductors constituting a stationary conductor and a movable conductor are disposed in a hollow cylindrical insulation body and one end side of said hollow cylindrical insulation body is sealed in vacuum tightness via an end plate and a bellows, characterized in that said stationary conductor is attached to the other end side of said hollow cylindrical insulation body so as to seal said hollow cylindrical insulation body in vacuum tightness thereby at a joint portion therewith;

wherein the cross sectional area of said stationary conductor near the joint portion with said hollow cylindrical insulation body is varied depending on variation of magnitude of bending moment with respect to distance near the joint portion.

3. A vacuum circuit interrupter in which a pair of separable conductors constituting a stationary conductor and a movable conductor are disposed in a hollow cylindrical insulation body and one end side of said hollow cylindrical insulation body is sealed in vacuum tightness via an end plate and a bellows, characterized in that said stationary conductor is attached to the other end side of said hollow cylindrical insulation body so as to seal said hollow cylindrical insulation body in vacuum tightness thereby at a joint portion therewith;

wherein said stationary conductor is provided with a groove at the end thereof which constitutes the joint portion with said hollow cylindrical insulation body, and an inwardly projecting face into said hollow cylindrical insulation body.

4. A vacuum circuit interrupter in which a pair of separable conductors constituting a stationary conductor and a movable conductor are disposed in a hollow cylindrical insulation body and one end side of said hollow cylindrical insulation body is sealed in vacuum tightness via an end plate and a bellows, characterized in that said stationary conductor is attached to the other end side of said hollow cylindrical insulation body so as to seal said hollow cylindrical insulation body in vacuum tightness thereby: and further, at least one of a space between said stationary conductor and said hollow cylindrical insulation body and space between said movable conductor and said hollow cylindrical insulation body is double sealed in vacuum tightness.

5. A vacuum circuit interrupter according to claim 4, characterized in that said stationary conductor is provided with at least two joint portions with said hollow cylindrical insulation body, wherein the space between the joint portions is evacuated.

6. A vacuum circuit interrupter according to claim 4, further comprising a plurality of bellows, wherein one ends of the plurality of bellows are jointed to said movable conductor, at least one of the other ends of the plurality of bellows is jointed to said hollow cylindrical insulation body, and the space between the plurality of bellows is evacuated.

7. A vacuum circuit interrupter in which a pair of separable conductors constituting a stationary conductor and a movable conductor are disposed within a hollow cylindrical insulation body and one end side of said hollow cylindrical insulation body is sealed in vacuum tightness via a metal end plate and a bellows, said stationary conductor is attached to the other end side of said hollow cylindrical insulation body so as to seal said hollow cylindrical insulation body in vacuum tightness thereby, and the joining portion of said stationary conductor with said hollow cylindrical insulation body is joined by a ring shaped brazing member having a first bent portion formed along the inner circumference thereof which is designed to guide said stationary conductor, a second bent portion formed along the outer circumference thereof which is designed to guide said hollow cylindrical insulation body, and projections arranged along the circumference thereof at a predetermined interval.

8. A vacuum circuit interrupter according to claim 7, further comprising a plurality of bellows, wherein one ends of the plurality of bellows are joined to said movable conductor, and at least one of the other ends of the plurality of bellows is joined to said hollow cylindrical insulation body by a ring shaped brazing member having a bent portion along the inner circumference thereof which is designed to guide said hollow cylindrical insulation body, and projections arranged along the circumference thereof at a predetermined interval.

9. A vacuum circuit interrupter according to claim 7, further comprising a plurality of bellows, wherein one ends of the plurality of bellows are joined to said movable conductor, and at least one of the other ends of the plurality of bellows is joined to the end of said metal end plate at said hollow cylindrical insulation body side by a ring shaped brazing member having a first bent portion formed along the inner circumference thereof which is designed to guide said metal end plate, a second bent portion formed along the outer circumference thereof which is designed to guide said hollow cylindrical insulation body, a step portion which is designed to guide at least one of the other ends of the plurality of bellows, and projections arranged along the circumference thereof at a predetermined interval.

* * * * *